US005178967A

United States Patent [19]

Rosenfeld et al.

[11] Patent Number: 5,178,967

[45] Date of Patent: Jan. 12, 1993

[54] BILAYER OXIDE FILM AND PROCESS FOR PRODUCING SAME

[75] Inventors: Aron M. Rosenfeld; Paul Smits, both of Kingston, Canada

[73] Assignee: Alcan International Limited, Montreal, Canada

[21] Appl. No.: 476,969

[22] Filed: Feb. 8, 1990

Related U.S. Application Data

[63] Continuation-in-part of Ser. No. 306,802, Feb. 3, 1989, abandoned.

[51] Int. Cl.[5] ..... C25D 11/04; C25D 11/26; B32B 9/00

[52] U.S. Cl. ..... 428/697; 156/150; 156/151; 156/230; 156/234; 156/238; 156/239; 205/138; 205/139; 205/171; 205/173; 205/189; 205/190; 205/202; 205/229; 205/819; 428/699; 428/701

[58] Field of Search ..... 204/37.6, 38.3, 42; 156/230, 233, 289, 234, 150, 151, 238, 239; 428/43, 699, 697, 701; 205/106, 138, 139, 152, 171, 173, 175, 189, 190, 201, 202, 229

[56] References Cited

U.S. PATENT DOCUMENTS

| | | | |
|---|---|---|---|
| Re. 29,739 | 8/1978 | Kessler | 204/56 R |
| 3,953,625 | 4/1976 | Quaintance et al. | 427/258 |
| 4,190,315 | 2/1980 | Brettle et al. | 350/96.12 |
| 4,430,387 | 2/1984 | Nakagawa et al. | 428/579 |
| 4,631,112 | 12/1986 | Usui et al. | 156/644 |
| 4,714,528 | 12/1987 | Takeuchi et al. | 204/33 |
| 4,717,457 | 1/1988 | van der Werf et al. | 428/701 |
| 4,921,823 | 5/1990 | Furneaux et al. | 502/4 |

FOREIGN PATENT DOCUMENTS 817099 3/1981 U.S.S.R. .

OTHER PUBLICATIONS

W. L. Baun, J. of Materials Science, 15 (1980), pp. 2749–2753.

L. Young, Anodic Oxide Films, Transactions Faraday Society, 58, 1957, pp. 841–847.

R. E. Pawel et al., A Submicron Sectioning Technique . . . , J. Applied Physics, vol. 35, No. 2, Feb. 1964, pp. 435–438.

R. E. Pawel et al., Impurity Distributions in Anodic Films on Tantalum, J. Electrochem. Soc., vol. 119, No. 1, Jan. 1972, pp. 24–29.

Y. Hirayama et al., "Porous Anodic Oxide Films for Perpendicular Magnetic Media", *Extended Abstracts,* vol. 86-1, No. 1, May 1986, p. 65, Abstract No. 50.

*Primary Examiner*—John Niebling
*Assistant Examiner*—William T. Leader
*Attorney, Agent, or Firm*—Cooper & Dunham

[57] ABSTRACT

A bilayer oxide film which comprises a preferably porous layer containing aluminum oxide and a non-porous layer comprising an oxide of a valve metal, e.g. tantalum. The layers are integral. The film is produced by forming a coating of aluminium or an anodizable aluminum alloy on a valve metal (or alloy), anodizing the resulting structure in an electrolyte (preferably one capable of converting the aluminum (or alloy) to a porous oxide film) in the presence of an adhesion-reducing agent (e.g. fluoride ions) that makes the resulting anodized bilayer film easily detachable from the remaining valve metal. The bilayer film is then detached from the valve metal, e.g. by adhering a flexible plastic film to the bilayer and using the film to peel off the bilayer from the valve metal. The resulting bilayer can be used for a variety of purposes, e.g. as a vapor or oxygen barrier useful for packaging, or as a coating containing magnetic particles used to make a magnetic recording medium.

31 Claims, 9 Drawing Sheets

BILAYER OXIDE FILM AND PROCESS FOR PRODUCING SAME

CROSS-REFERENCE TO RELATED APPLICATION

This application is a Continuation-in-part of our prior application Ser. No. 306,802 filed on Feb. 3, 1989, now abandoned.

BACKGROUND OF THE INVENTION

I. Field of the Invention

This invention relates to a process for producing films made up of two different metal oxides in which a first metal oxide predominates at one side of the film and a second metal oxide predominates at the other side of the film (such films being referred to hereinafter as bilayer oxide films). The invention also relates to bilayer oxide films produced by the method and to devices incorporating such films.

II. Description of the Prior Art

Metal oxides have a variety of useful physical and chemical properties, such as inertness, stability, abrasion resistance, resistance to high temperatures, etc. This makes metal oxides particularly useful as coatings for other materials or in other applications in which they are required to be in the form of supported or unsupported thin films. We have also found it particularly useful for certain applications to provide bilayer oxide films which make use of the different properties of two different metal oxides.

Metal oxide films are often produced by vapour deposition techniques but these methods are not always entirely suitable. For example, these methods involve high temperatures due to the high melting point (for evaporation) and high heat of condensation (for sputtering) of these oxide materials. Consequently heat sensitive substrates can be damaged or destroyed. Vapour deposition techniques also usually involve the use of high vacuums which may cause out-gassing from certain materials, such as paper, making the methods unsuited for the coating of such substrate materials. A further disadvantage is that it is expensive using the known techniques to produce bilayer films, i.e. those in which a first metal oxide predominates at one side of the film and a second metal oxide predominates at the other side of the film.

It is accordingly an object of the present invention to provide a process for producing bilayer metal oxide films which overcomes these disadvantages and makes it possible to produce films of this type as coatings on a variety of substrates or as unsupported films.

One possible way of producing bilayer oxide films is by anodizing a structure comprising a layer of a metal which can be anodized to consumption (e.g. aluminum) deposited on a metal which at least forms a barrier anodic film (e.g. a valve metal). However, oxide films formed in this way normally adhere tenaciously to the substrate metal and cannot therefore be transferred to other substrates. This type of procedure is mentioned in Russian Patent No. 817 099 to P. P. Khanzhin et al published on Mar. 30, 1981. In this reference, an aluminum foil is deposited (by rolling or vacuum spraying) onto a substrate made of a valve metal (e.g. titanium) and anodization is carried out until all the aluminum and some of the underlying valve metal is consumed. According to this reference, the anodic layer can easily be separated from the substrate "by a slight mechanical action" with the separation taking place at the interface between the aluminum oxide layer and the valve metal oxide layer. It would therefore seem that a bilayer oxide film is not produced when the film is separated from the substrate. Moreover, attempts to duplicate this procedure have resulted in the formation of anodized films that cannot easily be removed from the substrate.

A similar procedure is disclosed in an article by W. L. Baun entitled "Anodization of evaporated aluminum on Ti-6 wt. % Al-4 wt. % V", Journal of Materials Science, 15 (1980) 2749–2753. Baun tried to adapt the well-known technology for porous anodizing Al, used to prepare the surface for adhesive bonding, to Ti by evaporating a layer of Al onto a Ti substrate and then treating it according to the standard procedures known for Al. The anodic film thus obtained did not have the porous structure associated with similarly prepared films on Al alloys. Rather than a bilayer film, a non-porous mixed Al—Ti oxide structure was formed. Furthermore, the article states that the duplex oxide forms a strong bond to the underlying metal and presumably could not be easily detached.

SUMMARY OF THE INVENTION

Despite these negative indications of the prior art, we have found that anodization techniques can be used to form bilayer films and that the films can be made readily and uniformly detachable from the metal substrates and are thus transferable.

According to one aspect of the invention there is provided a process for producing a bilayer oxide film comprising a layer containing aluminum oxide and a layer containing an oxide of a valve metal, said process comprising: providing a substrate comprising said valve metal or an anodizable alloy of the valve metal, at least at an exposed surface thereof; forming a coating on said surface of a material selected from aluminum and anodizable aluminum alloys; anodizing said coated substrate for a sufficient time and at a sufficient voltage to consume said coating and some of said valve metal of said substrate to form a bilayer oxide film, said anodization being carried out in the presence of an adhesion-reducing agent capable of reducing the strength of attachment of the bilayer film to the remaining metal; and detaching said bilayer film from said remaining metal.

According to another aspect of the invention there is provided a bilayer oxide film comprising: a layer of aluminum oxide and a layer of an oxide of a valve metal, said layers being integral; said film having been produced by a process which comprises: providing a substrate comprising said valve metal or an anodizable alloy of the valve metal, at least at an exposed surface thereof; forming a coating on said surface of a material selected from aluminum and anodizable aluminum alloys; anodizing said coated substrate for a sufficient time and at a sufficient voltage to consume said coating and some of said valve metal of said substrate to form a bilayer oxide film, said anodization being carried out in the presence of an adhesion-reducing agent capable of reducing the strength of attachment of the bilayer film to the remaining metal; and detaching said bilayer film from said remaining metal.

The invention also relates to a polymer film having a coating of a bilayer oxide film and to magnetic recording media incorporating a bilayer oxide film.

The "bilayer" oxide films produced by the process of the present invention may consist of two homogenous layers with a sharp interface between them, or two homogenous layers separated by a region in which the two different oxides are mixed or mingled together, or a layer at one surface consisting predominantly of one oxide and a layer at the other surface consisting predominantly of the other oxide, with a gradual change of ratio of the oxides from one surface to the other. The actual structure obtained depends on the choice of the valve metal and on the conditions employed for the anodization step. However, it should be understood that the term "bilayer" as used throughout this specification is intended to encompass all these types of structure.

The valve metals are a group of metals including Ta, Nb, Zr, Hf and Ti which, when subject to anodization, form a substantially non-porous barrier anodic film having a maximum thickness dependent upon the voltage employed for the anodization step. These metals are not anodized to consumption unless they are present in extremely thin layers that can be consumed before the maximum anodic film thickness is reached. In the present invention, the valve metal layers have such a thickness that some of the valve metal remains unconsumed after the anodization procedure.

The preferred valve metals are tantalum, niobium and titanium, and tantalum is most preferred because of the ability of its oxide to resist attack by most chemicals.

It will be appreciated from the above that, as well as using aluminum and the valve metals themselves, it is also possible to use anodizable alloys of these metals in the process of the present invention. For the sake of simplicity in the following description, however, reference is generally made only to the metals themselves.

Figure 1A:
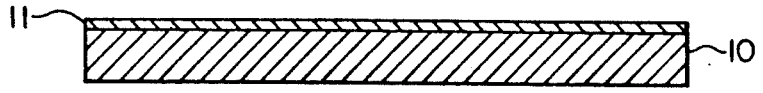
FIGS. 1A–1E are a series of cross-sections showing the steps in a preferred process according to the present invention.
Figure 1B:
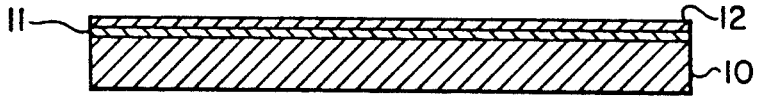
Figure 1C:
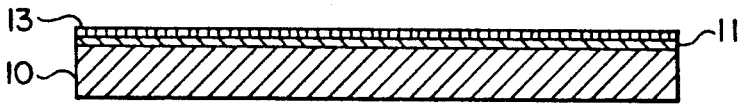
Figure 1D:
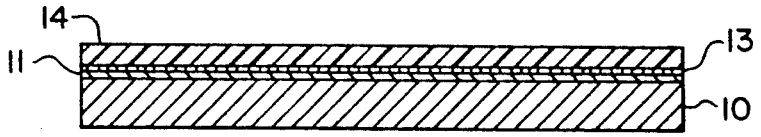
Figure 1E:
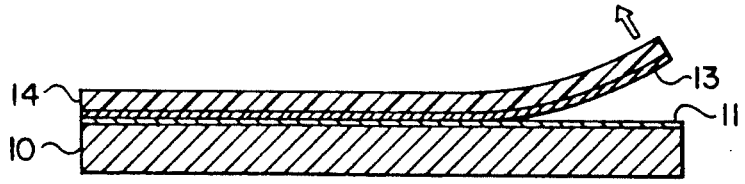

It should be noted that in the various figures of drawings (apart from FIGS. 11 to 13) no attempt has been made to show the relative thicknesses of various layers to scale.

DETAILED DESCRIPTION OF THE INVENTION

The present invention is based, at least in part, on the finding that bilayer oxide films can be formed by anodization and that certain materials, notably fluorides, are capable of making the bilayer oxide film easily detachable at the interface between the layer of valve metal oxide and the unconsumed valve metal when such materials are present during the anodization step. These materials are referred to herein as "adhesion-reducing agents".

When the adhesion-reducing agent is a fluoride, it may be in the form of simple salts, e.g. NaF or KF, or in the form of complex salts, or fluorine-containing compounds or in acids such as hydrofluoric acid, fluoroboric acid, etc. While the Baun article referred to above refers to an initial treatment of the valve metal with a fluoride-containing etchant, and some experiments were carried out in fluoride-containing etchants, there is no mention of this producing a detachable film and, to the contrary, it is stated that the duplex oxide forms a strong bond.

The adhesion-reducing agent may be added to the electrolyte prior to or during the anodization step or may be coated onto the metal surface prior to the start of the anodization procedure. It is alternatively possible to carry out a part of the anodization step without the adhesion reducing agent and to carry out another part of the anodization procedure in the presence of the adhesion-reducing agent.

The amount of the adhesion-reducing agent required in any particular case can be determined by simple trial and experimentation. When the agent is a fluoride, the amount can be as low as about 0.003% by volume of the electrolyte, but is more usually at least about 0.05% by volume of the electrolyte.

Prior to the anodization step, the structure to be anodized is prepared by providing an aluminum coating on a valve metal substrate. The valve metal may be in the form of a self-supporting body, sheet, foil or plate, but is preferably itself in the form of a thin layer supported on a further co-anodizable substrate (e.g. an aluminum foil, sheet or plate). This reduces costs because valve metals tend to be expensive. The valve metals can be coated on the substrates by any suitable techniques, but vapour deposition techniques such as physical vapour deposition (PVD) or chemical vapour deposition (CVD) are particularly preferred because the characteristics of the resulting valve metal layer make subsequent separation of the bilayer film highly reliable over large areas. Sputtering and vacuum evaporation are the most preferred techniques. The thickness of the valve metal layer should be large enough that not all of the metal is consumed during the anodization step, and thicknesses of at least 20 nm are normally suitable.

As noted above, in the region where the anodized aluminum and anodized valve metal meet following the anodization step, there may be a sharp division between the aluminum oxide layer and the valve metal oxide layer, or there may be a region where the oxides mix or merge. In any event, separation of the film at this interface is not desired since this would leave most or all of the underlying barrier layer on the substrate metal during detachment of the film. We have found that this undesired separation does not normally take place in the process of the present invention and can be avoided entirely by choosing an appropriate coating method for the aluminum which results in intimate contact between the aluminum layer and the valve metal layer. While a variety of coating methods are suitable, vacuum sputtering and vacuum evaporation of the aluminum are preferred. In particular, sputtering is relatively quick and inexpensive and can give good control over the aluminum coating thickness.

The aluminum oxide layer of the bilayer film may be either non-porous or porous depending on the electrolyte used for the anodization step. When the electrolyte contains certain acids, e.g. phosphoric acid, sulfuric acid or oxalic acid, partial dissolution of the oxide film takes place as the anodization proceeds and open pores extend inwardly from the oxide surface towards the substrate metal. However, when the anodization proceeds into the valve metal, a non-porous barrier layer is formed, even when such acids are present in the electrolyte. The film resulting from the porous anodization is particularly preferred in the present invention because it comprises pores which are open at one surface of the film but are closed at the other surface, and this has particular advantages for reasons that will be apparent later. Moreover, the non-porous barrier layer of valve metal oxide tends to be dense and durable so that it provides an impermeable protective surface on one side of the film. Because of the preferred status of these pore-containing films, the following description is largely concerned with them, but it should be kept in mind that films having a non-porous aluminum oxide layer can also be formed by the same techniques simply by using an electrolyte that does not contain a pore-forming acid.

The thickness of the aluminum coating to be applied to the substrate valve metal depends on the desired thickness of the anodic film. Normally, the aluminum can be applied to a thickness in the range of 10 nm to tens of microns (e.g. 50μ) which is then converted to an aluminum oxide layer generally 30 to 40% thicker during the anodization step. When the resulting anodic film is very thin (less than 1000 nm), the film may appear to be coloured prior to its detachment from the substrate valve metal as a result of light interference and absorption effects, and such colour-generating structures are the subject of our co-pending U.S. patent application Ser. No. 306,766 filed on Feb. 3, 1989. However, the bilayer oxide films resulting from the detachment of these extremely thin films from the substrate metals may be useful for the purposes mentioned herein and consequently are included within the scope of the present invention.

The anodization step can be carried out in the conventional manner suitable for the anodization of aluminum or aluminum alloys. For example, a voltage in the range of 3–200 volts but more conveniently in the range of 5–25 volts may be employed at ambient temperature in a suitable electrolyte containing sulfuric, phosphoric acid or oxalic acid if a pore-containing film is desired. The time required for the anodization depends on the thickness of the required duplex film, and the anodization normally proceeds at a rate of 0.1 to 1 micron per minute.

It was mentioned above that the thickness of the valve metal oxide layer of the anodic films depends on the voltage used for the anodization procedure and thicker films are produced at higher voltages. Thus, either high voltages can be used for the anodization of aluminum to produce thick films of valve metal oxides or these can be formed by initially anodizing the Al at a lower convenient voltage e.g. 5–25 volts and then raising the voltage once the aluminum has been consumed to a value within the range of about 25 to 200 volts. The choice of voltage and technique depends to some extent on what pore size is required in the Al oxide since pore diameter is proportional to anodizing voltage to the extent of about 10 Å/v. Using either technique, valve metal oxide layers of up to 350 nm in thickness can be obtained.

The bilayer oxide films can be separated from the underlying substrate metal and transferred to another substrate by any convenient method but the most effective way is by adhering a thin flexible sheet of the new substrate onto the anodized film while it is still attached to the substrate valve metal and then gradually peeling the sheet and the attached bilayer oxide film from the substrate metal. If an adhesive is used for the attachment of the flexible sheet to a pore-containing film, the adhesive may enter the pores in the bilayer film. If this is not desired, a heat sealable material (e.g. a polyester or polypropylene) may be used as the new substrate since this allows the attachment of a sheet without the use of an adhesive. When an adhesive is to be employed, it is preferable to use a UV-curable adhesive (e.g. NORLAND OPTICAL ADHESIVE) because such adhesives tend to be very transparent when cured and because the curing step (exposure to ultraviolet light) is quick and effective.

The film may subsequently be removed from the new substrate, if desired, and either transferred to a further substrate (e.g. if it is desired to have the open pore surface of a pore-containing film exposed) or used in unsupported form. When an unsupported film is desired, the substrate to which it was originally transferred should be removed by some method that does not apply destructive physical force to the thin film, e.g. the substrate can be oxidized (e.g. burned off) if it is organic or it could be dissolved if it is soluble (e.g. polyvinyl alcohol) in a suitable solvent.

While it is preferable to apply the bilayer oxide film to a plastic substrate, the film can in fact be applied to a substrate of virtually any kind either with or without the use of an adhesive as the substrate permits. Examples of substrates other than plastic include textiles, wood and paper.

Instead of making the new substrate to Which the anodic film is initially applied thin and flexible in order to facilitate peeling of the film from the metal, the metal substrate itself can be made thin and flexible so that this can be peeled away from the anodic film when the latter is attached to a less flexible material. This has the advantage that the anodic film remains flat and securely supported during the detachment from the metal and is thus less susceptible to cracking or breaking. The metal substrate can be made sufficiently flexible either by using a thin foil of the valve metal or a thin foil of a less expensive metal (e.g. Al) carrying a thin layer of the valve metal.

For some applications it may be necessary to deposit a material into the pores of a pore-containing anodic film. For example, when the film is to be used as a magnetic coating, a magnetic metal such as Fe, Ni, or Co may be deposited into the pores. The deposition of such materials into the pores can conveniently be carried out prior to the removal of the duplex film from the substrate valve metal, for example either by electrodeposition or by electroless deposition using standard techniques known in the art of anodizing aluminium. When electrodeposition is employed, the metal tends to be deposited at the bottom regions of the pores (adjacent to the valve metal oxide layer). On the other hand, electroless deposition tends to deposit the metal evenly over the internal pore surfaces. The method appropriate for the intended application can thus be selected.

When the bilayer oxide film is applied to a substrate, the result is a substrate having an oxide coating on one side. If desired, more complicated structures can be produced by building upon the basic structure. For example, the anodization procedure can be repeated and a second bilayer film can be adhered to the first or to the uncoated side of the substrate Alternatively, two coated substrates can be produced and adhered together. Such structures may be desired to increase oxygen or moisture retardation of the substrate or for specialized applications.

The invention, and particularly its preferred embodiments relating to pore-containing anodic films, are described in more detail in the following with reference to the accompanying drawings.

FIG. 1 shows the steps of a preferred process according to the present invention. In step (a) a substrate 10, e.g. an aluminum foil, is coated with a thin layer 11 of a valve metal, e.g. tantalum. This is preferably carried out by vacuum sputtering, but could alternatively be carried out by vacuum evaporation, plasma spraying etc.

In step (b), the resulting structure is coated with a thin layer 12 of aluminum or an anodizable aluminum alloy, again by employing any suitable coating technique, e.g. one of those mentioned above.

In step (c), the aluminum layer is anodized to consumption and a surface region of the valve metal layer is also anodized until the current drops to zero. As a result, an anodized bilayer 13 is formed on the valve metal layer 11.

In step (d), the structure is coated with a flexible sheet 14 which is adhered to the bilayer 13.

In step (e) the flexible sheet 14 is used to detach the bilayer 13 from the valve metal layer 11.

Figure 2:
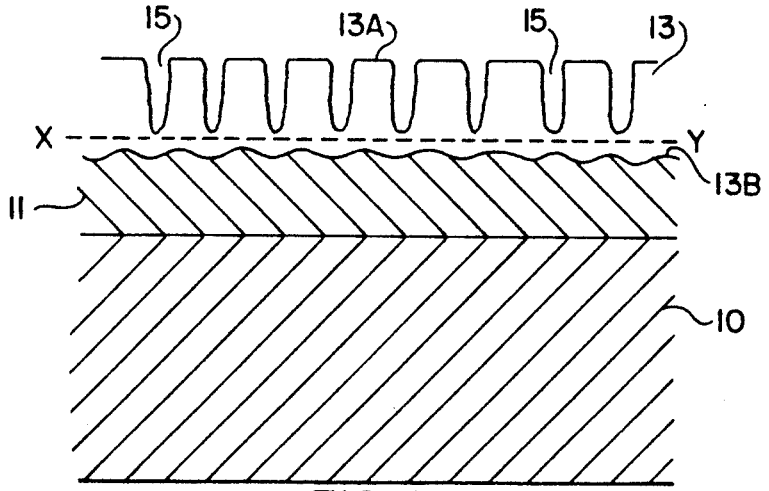
FIG. 2 is an enlarged cross-sectional view of the product of step (c) as shown in FIG. 1.

The product of step (c) of FIG. 1 is shown on an enlarged scale and in greater detail in FIG. 2. The bilayer 13 is an anodic film having an upper part 13A comprising $Al_2O_3$ and containing pores 15, and a lower part 13B which is substantially non-porous and contains the oxide of the valve metal. The dotted line X-Y represents the position of the aluminum/valve metal interface before the anodization step and it can be seen that the anodization has proceeded for a short distance into the valve metal layer 11.

When the anodization is carried out in the presence of fluoride ions or other adhesion-reducing agents, the film 13 is quite easily detachable from the underlying substrate at the interface between layers 11 and 13. This detachment can be carried out as in step (e) of FIG. 1 and the resulting structure is shown on an enlarged scale in FIG. 3. The structure consists of the bilayer 13 attached to the flexible film 14 on the open-pore side of the bilayer. The exposed opposite surface of the bilayer is imperforate and contains (or consists entirely of) the oxide of the valve metal.

Figure 4:
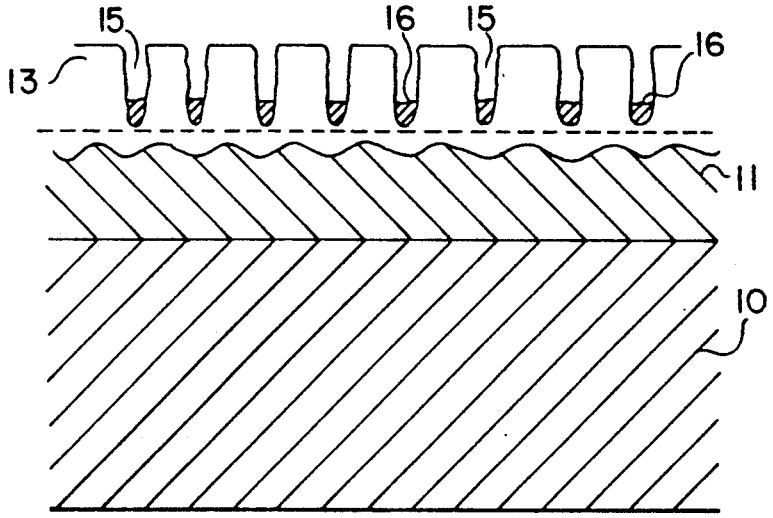
FIG. 4 is a cross-sectional view similar to FIG. 2 but showing a metal deposited in the pores.
Figure 5:
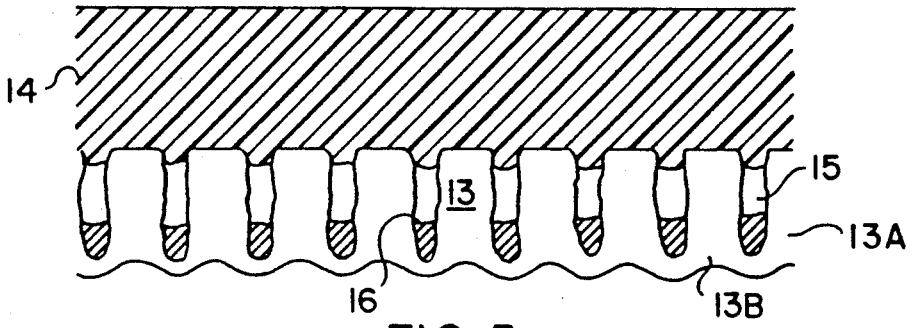
FIG. 5 is a cross-sectional view similar to FIG. 3, but showing a metal deposited into the pores.

If desired, a metal or other depositable material may be deposited in the pores 15 of the bilayer film. For example, if the product of step (c) of FIG. 1 is subjected to electrodeposition of a metal Prior to step (d), a metal deposit 16 is formed at the very bottoms of the pores 15, as shown in FIG. 4. Following step (e), the detached film has the structure as shown in FIG. 5 where the metal deposits 16 in the porous bilayer film 13 are protected by the imperforate part 13B of the bilayer on one side, and by the overlying flexible strip 14 on the other side.

If desired, the detached bilayer film 13 can be transferred to a different support and the flexible strip 14 removed, thus allowing free access of any fluid to the pores 15 and any deposits therein.

Figure 6:
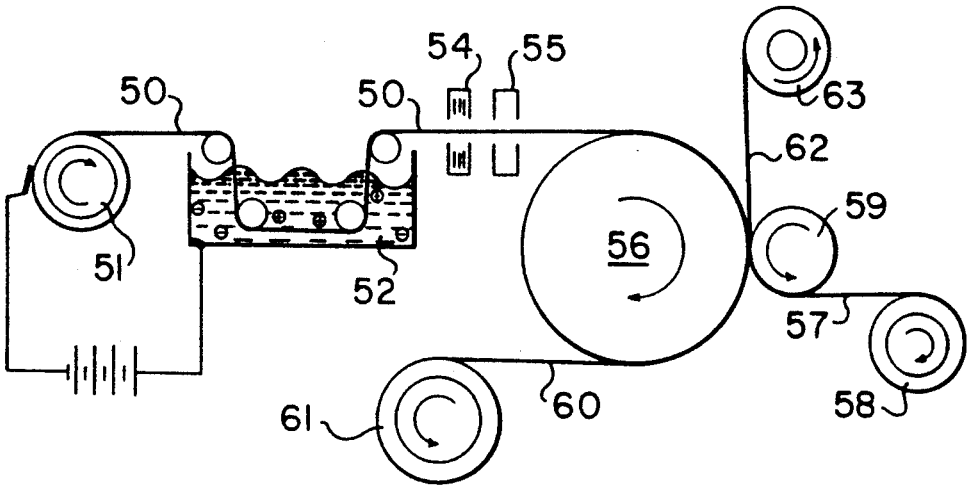
FIG. 6 is a schematic representation of apparatus suitable for forming a continuous web of plastic material having an attached bilayer anodic film.

FIG. 6 shows a simplified apparatus for the continuous production of plastic sheet having a bilayer anodic film as a surface coating on one side. A continuous foil 50 of aluminum having a surface coating of tantalum followed by aluminum on one side (the underside) is fed from a payoff roll 51 through an electrolyte bath 52. During the passage of the foil through the bath, porous anodization takes place in the presence of fluoride which is dissolved in the electrolyte. On emergence from the bath, the foil 50 has a surface anodic film 53 on one side which consists of a porous aluminum oxide layer and an underlying layer of non-porous tantalum oxide. After passing through rinsing and drying stations, 54,55 respectively, the foil is wound around a heated metal drum 56 of large diameter (approximately 2 feet). A heat sealable plastic sheet 57 is fed from pay off roll 58 into a nip formed between drum 56 and a counter chill roll 59. In the nip, the plastic sheet is pressed against the heated porous surface of the anodic film and is heat sealed to the film. Upon leaving the nip the anodic film is detached from the metal foil substrate and forms a coating for the plastic sheet. The stripped metal foil 60 is wound up on take up roll 61 and the coated plastic sheet 62 is wound up on take up roll 63.

The anodic films produced by the present invention, at least in its preferred forms, are particularly suitable for use in two specific applications, namely the production of air- and moisture-impermeable packaging films and the production of magnetic recording media. These specific applications are described in more detail below.

Resistance to oxygen and moisture penetration in plastic packaging is usually improved by metallizing the plastic with a thick, opaque layer of aluminum. There has been much interest and effort devoted to realizing a visually transparent barrier film that would have consumer appeal. The avoidance of metal layers would also allow for microwave compatibility.

Recently, a number of processes have been announced in which transparent films are produced by vapour depositing silicon oxide onto a plastic film (see for example Paper, Film and Foil Converter, June 1988 pp. 102–104). This approach, however, has a number of disadvantages, including the need for a polymeric topcoat to plug cracks and defects in the deposited silicon dioxide film, the limited fold endurance and crease resistance, the somewhat yellow colour of the film composition having the best barrier properties, etc.

Accordingly, there is a need for a transparent barrier film having good adhesion to plastic, flexibility and durability. These features are present in the bilayer oxide film of the present invention, at least in its preferred forms.

When a pore-containing film is produced, the porous anodic side provides an excellent surface for heat-seal laminating to the plastic substrate. This is evidenced by the well-established technology for adhesive bonding of aluminum based on a phosphoric acid porous anodized film as an intermediate bonding layer (see J. D. Minford Adhesive Age 17 (1974) 24, the disclosure of which is incorporated herein by reference). The heat-seal polymer in such a process infiltrates the porous structure to some extent leading to a composite polymer/oxide structure which is stronger and more flexible than an oxide film directly deposited onto a plastic substrate.

The valve metal oxide layer of the bilayer film, and especially tantalum oxide, is dense and amorphous as well as highly chemically resistant offering good barrier properties and durability. Moreover, anodic tantalum oxide has been found to be surprisingly ductile relative to other oxides which are normally brittle (see S. F. Bubar and D. A. Vermilyea, J. Electrochem. Soc. 113, (1966) 892 and ibid 114 (1967) 882, the disclosures of which are incorporated herein by reference). Thus the bilayer films have good flexibility.

Figure 3:
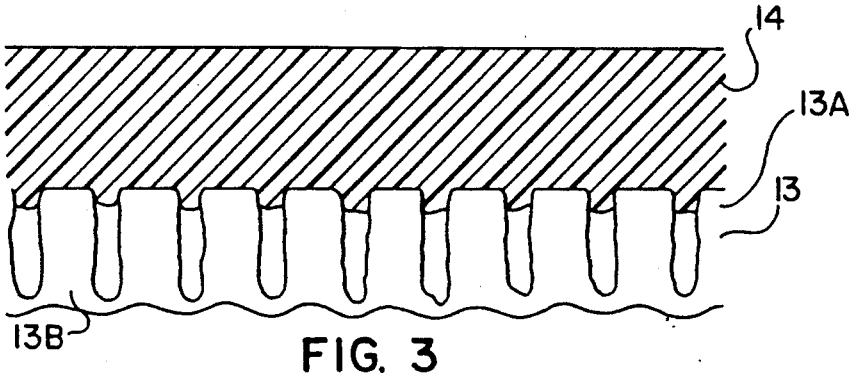
FIG. 3 is an enlarged cross-sectional view of the product of step (e) of FIG. 1.

An example of a preferred plastic film having an attached bilayer anodic film would have the structure as shown in FIG. 3 with the bilayer 13 comprising a porous aluminum oxide layer 13A and a dense tantalum oxide layer 13B, the porous surface being heat sealed to a conventional packaging film 14. As can be seen, the plastic of the film partially infiltrates the porous Al oxide layer.

The other area of particular applicability relates to the production of magnetic recording devices.

Conventional magnetic media for recording information storage consist typically of fine magnetic particles, such as iron oxide, dispersed in a polymeric binder media which is spin coated as a thin film onto a rigid disk or applied to a flexible web for tape or floppies. More recently the use of continuous thin magnetic films vacuum deposited onto a disk or flexible web has been developed.

A third type of magnetic media for rigid disks consists of an Al platter anodized to provide a porous anodic film over the surface in which magnetic particles such as cobalt are electrodeposited into the pores (see S. Kawai, R. Ueda, J. Electrochem. Soc. 122 (1975) 32.). Recently this type of media has been extended to flexible substrates (see N. Tsuya, T. Tokushima, M. Shiraki, Y. Umehara, IEEE Trans. Mag. vol. 24 (1988), 1790) in a process where plastic film such as polyester is vacuum deposited by evaporation with Al to a thickness of several microns then anodized and electrodeposited as for rigid media.

A disadvantage of this approach is that using a thin film initially and particularly after an appreciable portion of Al is consumed in the anodizing, the residual Al cannot support high currents and so the anodizing can only be accomplished at low rates. Additionally, the appreciable resistance of the web at its centre relative to the edges, leads to non-uniform anodizing across the width of the web. Moreover, the heat generated due to the resistance of the Al film can have a deleterous effect on the porous anodic film, which is sensitive to temperature, and hence on the magnetic properties.

All of these difficulties would be removed by having a much thicker conductive layer of Al than is actually needed for the anodic film thickness, but this would seriously limit the rate of the vacuum deposition stage.

Our present invention can be used to form the electrodeposited anodic film on a foil of Al sputtered with an Al/Ta film, and apply the anodization process to then transfer this film to a plastic substrate. The anodizing can be done at very high speed and with excellent uniformity due to the thick conductive foil.

The Ta oxide in the bilayer anodic film plays a definite role as a protective overlayer of precisely controlled thickness. In conventional processing such a protective layer (typically $SiO_2$) is sputtered as an additional process step.

Figure 7:
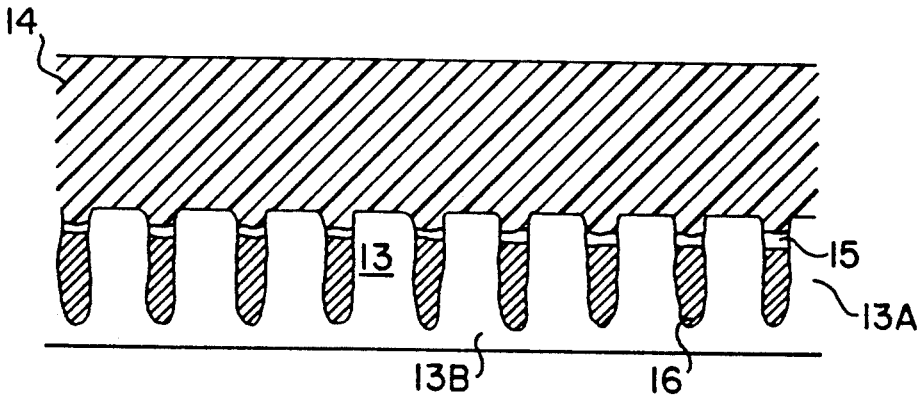
FIG. 7 is a cross-sectional view of a magnetic recording media produced by a process of the invention.

An example of a recording medium of this type would have the structure shown in FIG. 7 in which the bilayer film 13 comprises a porous aluminum oxide layer 13A and a dense tantalum oxide layer 13B acting as a hard protective covering of precise thickness. The pores 15 contain an electrodeposited magnetic material 16 such as cobalt. The film is heat sealed to a plastic substrate 14 such as a conventional tape or disk of the type used for recording media. The structure is very similar to FIG. 5, except that the pores 15 are almost completely filled with the magnetic deposits 16.

Structures having more than one bilayer oxide film can be produced by building upon the basic structure of FIG. 3. Examples of such structures are shown in FIGS. 8, 9 and 10.

Figure 8:
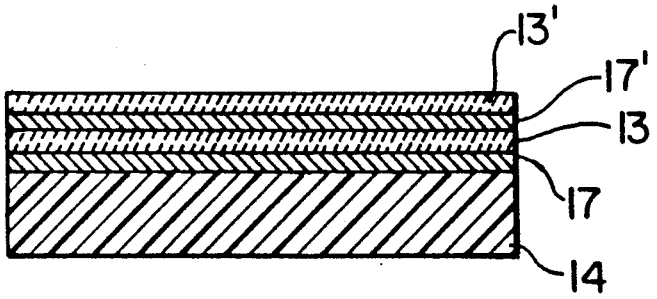
FIGS. 8, 9 and 10 are cross-sections of additional structures comprising two bilayer oxide films and/or two polymer sheets in combination.

FIG. 8 shows a structure in which a polymer sheet 14 is provided with two bilayer oxide films 13 and 13' on one surface. A structure of this type can be formed by first forming the structure of FIG. 3, except that, in this case, a layer of adhesive 17 was used to adhere the sheet 14 to the bilayer film 13 prior to the removal of the film from the valve metal, and this layer remains in the resulting packaging structure as shown. After removal of the bilayer film 13 from the underlying valve metal, the valve metal is again coated with aluminum or an anodizable aluminum alloy and anodized to form a second bilayer film 13'. A further layer of adhesive 17' is coated on the resulting bilayer film and the previously coated sheet 14 is then attached to the bilayer film 13' via the adhesive layer 17' and the film 13' is peeled from the valve metal. The resulting structure is then as shown in FIG. 8.

Figure 9:
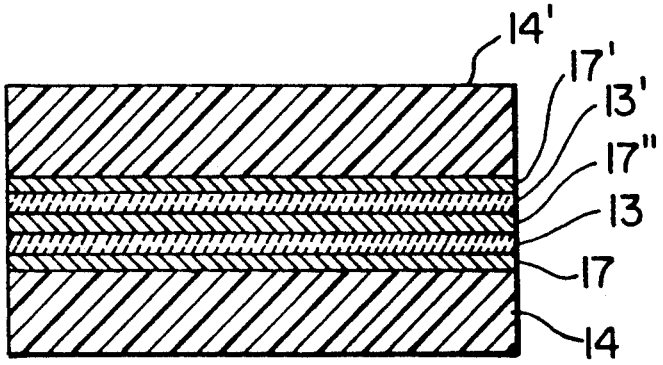

The structure shown in FIG. 9 has two layers of polymer sheet 14 and 14' joined together via two bilayer films 13 and 13' and three adhesive layers 17, 17' and 17'''. This structure is formed by first producing two structures of the type shown in FIG. 3 (again with an adhesive layer between the polymer sheet and the bilayer film), and then adhering the two structures together with the bilayer films facing each other via a further adhesive layer 17''.

Figure 10:
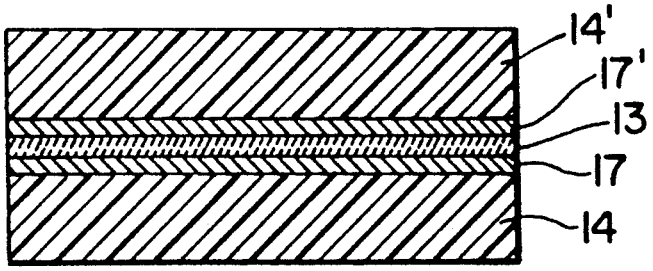
Figure 11A:
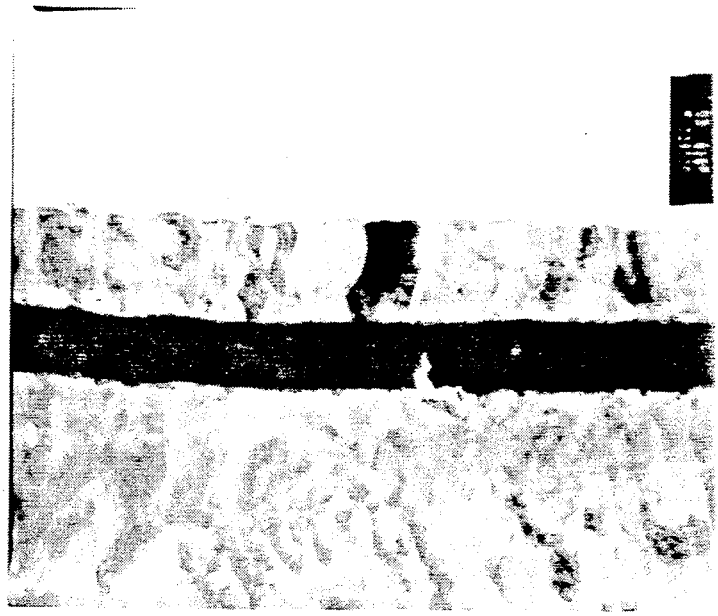
FIGS. 11A–11E, 12A–12B and 13A–13B are a series of photomicrographs showing actual structures of intermediates and products produced in Examples 1 to 3.
Figure 11B:
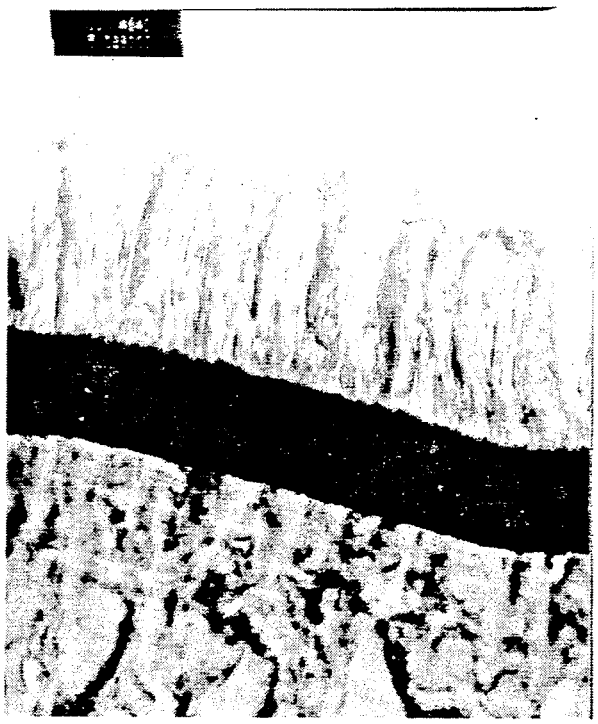
Figure 11C:
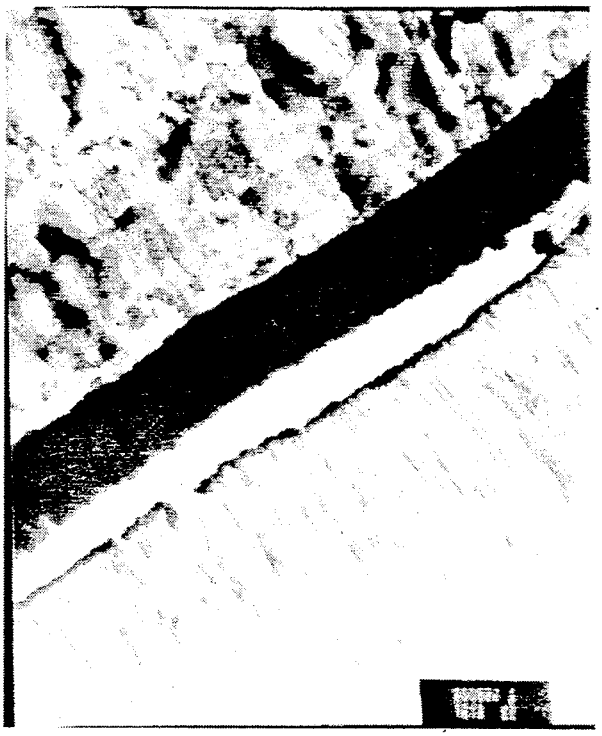
Figure 11D:
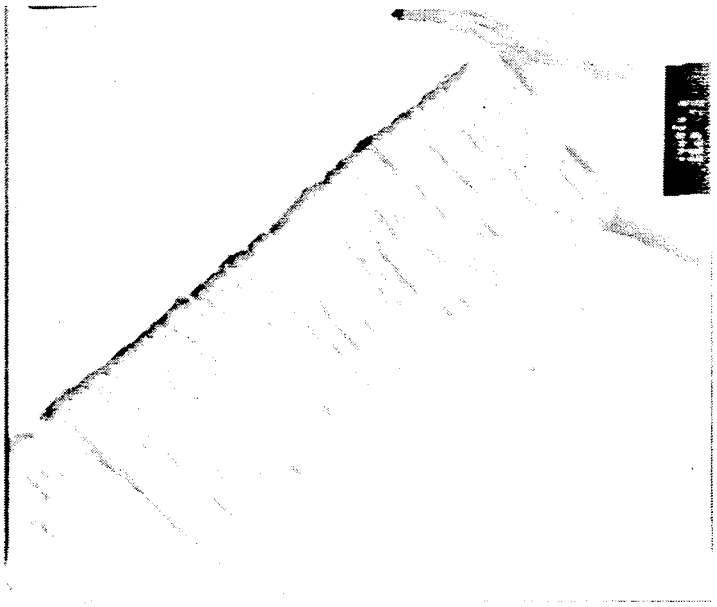
Figure 11E:
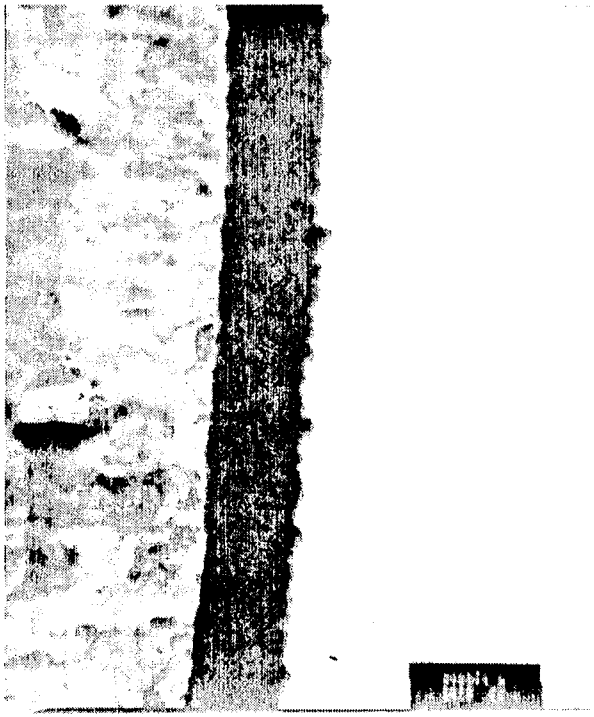

The structure of FIG. 10 has two layers of polymer sheet 14 and 14' attached via a single bilayer film 13 and two adhesive layers 17 and 17'. This structure is formed by first forming a structure of the type shown in FIG. 3 (with an adhesive layer 17) and then attaching a further layer of polymer sheet to the bilayer film 13 via a further layer of adhesive 17'.

Clearly further structures could be formed by similar techniques.

The following Examples illustrate the invention.

EXAMPLE 1

Tantalum metal was sputtered onto an aluminum foil to thickness of 5000 Å. Aluminum metal was then sputtered onto the tantalum coated foil to a thickness of 7000 Å.

The aluminum was anodized to consumption at 20 V in a 120 g/l solution of phosphoric acid maintained at 30° C. The electrolyte was doped with hydrofluoric acid at the level of 0.1% by volume and the anodization was continued into the tantalum layer until the current decayed to a low level. This produced a tantalum oxide barrier layer approximately 340 Å in thickness, corresponding to 20 V of anodizing, between the tantalum and the porous aluminum oxide layer. A flexible plastic strip was heat sealed to the structure and the anodic bilayer was detached from the remaining tantalum by pulling one edge of the plastic strip and peeling away the bilayer.

FIG. 11, comprising five cross-sectional transmission electron micrographs (a), (b), (c), (d), and (e), all at a magnification of 28,000X, illustrates the actual structures produced in accordance with this Example. Micrograph (a) shows the as-sputtered Al on Ta structure deposited onto Al foil. Micrograph (b) shows the as-anodized sputtered film with the porous anodic film (13) formed on the tantalum (11) after the anodization step. Micrograph (c) shows the as-anodized film with the oxide layer in the process of separating from the tantalum underlayer. Micrograph (d) shows the porous anodic film following its separation from the tantalum. The non-porous $Ta_2O_5$ barrier layer, approximately 340 Å thick, is visible on one side of the film. Micrograph (e) shows the tantalum layer (11) remaining after separation of the porous film.

EXAMPLE 2

Tantalum was sputtered on to aluminum foil to a thickness of 1500 Å. Aluminum was then sputtered on to the Ta coated foil to a thickness of 4000 Å. The coated foil was then anodized in 1.2M phosphoric acid at 30° and 15 V until the top Al layer was consumed and converted to oxide. The foil sample was then transferred to a bath of 0.4M phosphoric acid, doped with 0.005% by volume of hydrofluoric acid and anodized at 21° C. and 90 V for three minutes.

The anodized foil was then heat-sealed to polyethylene laminated polyester film at a temperature of 150° C. The aluminum foil was then peeled away from the polymer film transferring the anodic bilayer to it.

Figure 12A:
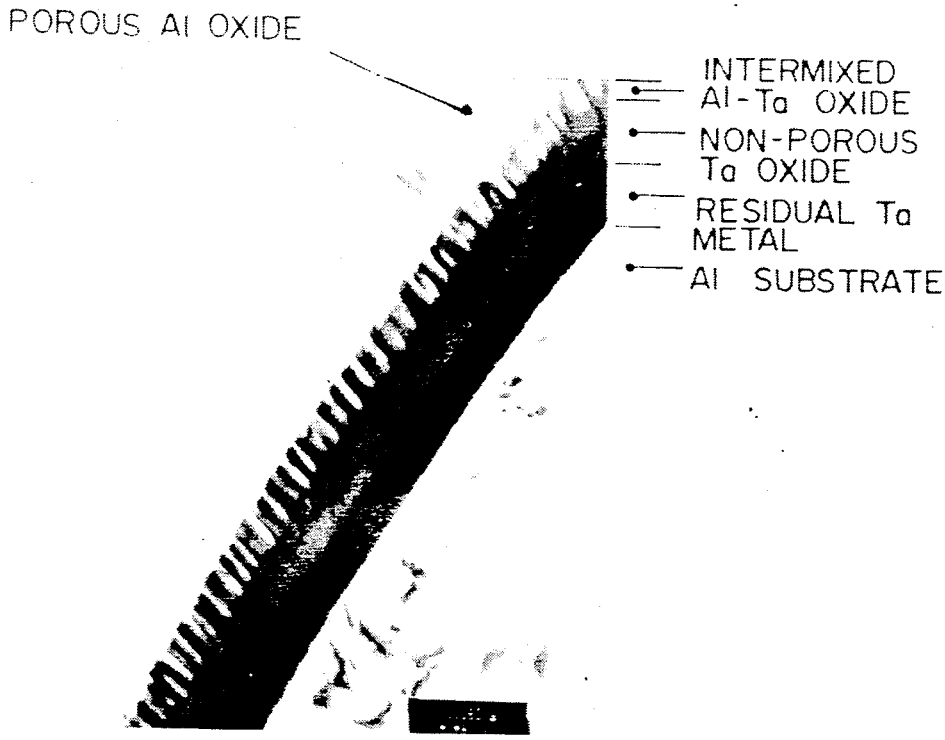
Figure 12B:
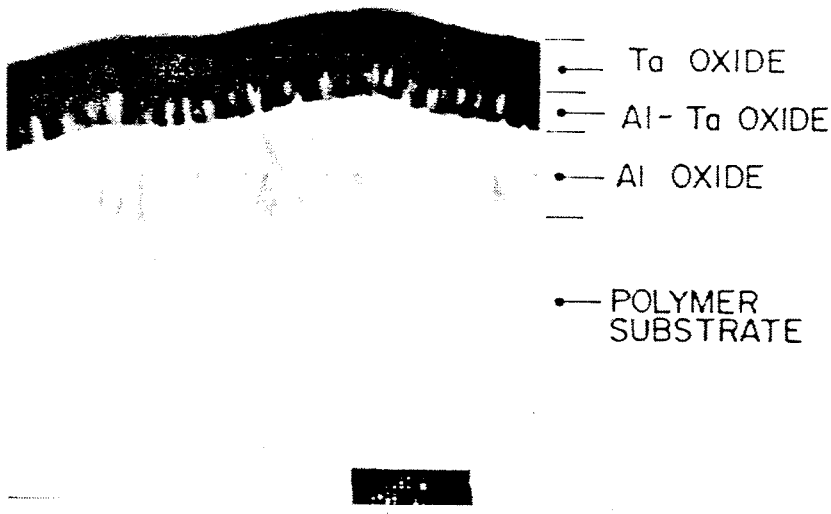

FIG. 12 shows the resulting structures. Photomicrograph 12(a) at 80,000X magnification shows a large diameter porous Al anodic layer on a thick 1500 Å non-porous Ta oxide layer prior to separation of the bilayer from the aluminum foil. An intermediate region of intermixed Al and Ta oxide is visible for this relatively thick bilayer film. Photomicrograph 12(b), also at 80,000X shows the bilayer anodic film transferred to the polymer substrate.

EXAMPLE 3

Aluminum was sputtered onto Tantalum coated aluminum foil as in Example 2. The coated foil was then anodized in 1.2M phosphoric acid, doped with 0.005% by volume of hydrofluoric acid, at 30° C. and 15 V until the top Al layer was consumed and the underlying Ta layer partially anodized to a thickness of 250 Å. The sample was then transferred to a standard Ni ANOLOK* electrodeposition bath. Electrodeposition of magnetic Ni particles into the pores of the anodic film was carried out using alternating current at 15 V rms and 60 Hz for 20 sec. The Ni loaded bilayer oxide was then transferred to a plastic substrate via heat-seal laminating as in Example 2.

* Registered Trade Mark of Alcan Aluminum Limited.

Figure 13A:
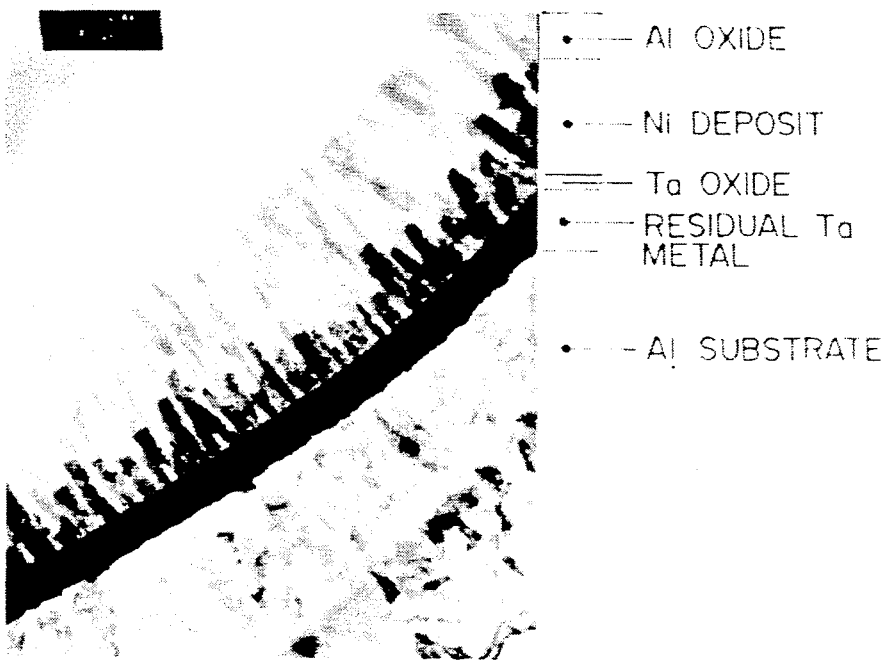
Figure 13B:
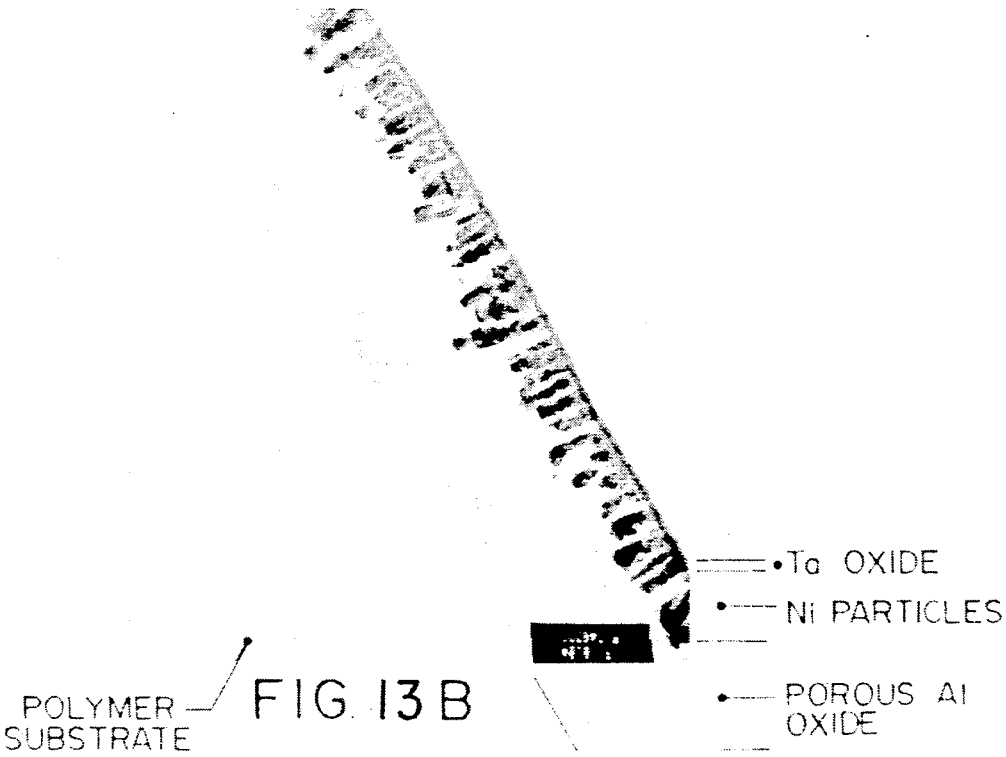

FIG. 13 shows the resulting structures. Photomicrograph 13(*a*) at 46,000X magnification shows the Ni loaded bilayer oxide prior to separation from the Al substrate. Photomicrograph 13(*b*), also at 46,000X, shows the same . structure transferred to the polymer substrate with a relatively thin non-porous Ta oxide layer at the outer surface above the Ni deposits.

What we claim is:

1. A process for producing a packaging film having low oxygen and moisture permeability including a bilayer oxide film comprising a layer containing aluminum oxide and a layer containing an oxide of tantalum or niobium, said process comprising:

providing a substrate comprising a metal, at least at an exposed surface of the substrate, selected from the group consisting of tantalum, niobium and anodizable alloys thereof;

forming a coating on said surface of a material selected from the group consisting of aluminum and anodizable aluminum alloys;

anodizing said coated substrate for a sufficient time and at a sufficient voltage to consume said coating and some of said metal of said substrate to form a bilayer oxide film, said anodization being carried out in the presence of a fluoride as an adhesion-reducing agent capable of reducing the strength of attachment of the bilayer film to the remaining metal;

attaching a flexible packaging sheet to said bilayer film; and detaching said flexible sheet and said bilayer oxide film from said remaining metal.

2. A process according to claim 1, wherein said valve metal is Ta.

3. A process according to claim 1, wherein said adhesion-reducing agent is a member of the group consisting of fluorine containing salts and fluorine containing acids.

4. A process according to claim 1, wherein said adhesion-reducing agent is present in an electrolyte used for said anodization step.

5. A process according to claim 4 wherein said adhesion-reducing agent is present in said electrolyte in an amount of at least 0.003% by volume.

6. A process according to claim 1, wherein said adhesion-reducing agent is applied to said coating prior to said anodizing step.

7. A process according to claim 1, wherein said coating is formed on said substrate by a vapour deposition technique.

8. A process according to claim 7 wherein said vapour deposition technique is sputtering.

9. A process according to claim 1, wherein said anodization is carried out in an electrolyte which results in the formation of a porous aluminum oxide layer as one layer of said bilayer oxide film.

10. A process according to claim 9 wherein a substance is deposited in pores in said porous layer.

11. A process according to claim 10 wherein said substance is deposited by electro-deposition prior to detaching said bilayer film from the remaining valve metal.

12. A process according to claim 10 wherein said substance is deposited by electroless deposition.

13. A process according to claim 1, wherein said anodization is carried out at a voltage in the range of 5 to 25 volts at least until said coating is consumed.

14. A process according to claim 13 wherein said voltage is increased to 25–200 V following the consumption of said coating.

15. A process according to claim 1, wherein said substrate comprising a layer of said Ta or Nb supported on a layer of a different material.

16. A process according to claim 15 wherein said Ta or Nb is deposited on said different material by a vapour deposition technique.

17. A process according to claim 1 which comprises the further steps, after detaching said bilayer film and attached packaging sheet from said remaining metal, of coating a metal substrate comprising a metal selected from the group consisting of Ta, Nb and anodizable alloys thereof, at least at an exposed surface thereof, with aluminum or an anodizable aluminum alloy, anodizing the coated metal substrate to cause an additional bilayer film to grow on said metal substrate, said anodization being carried out in the presence of a fluoride as an adhesion-reducing agent capable of making said additional bilayer film detachable from said metal substrate on which it is grown, attaching said oxide-coated packaging sheet to said additional bilayer film, and detaching said additional bilayer film and attached oxide coated packaging sheet from said metal substrate on which said additional bilayer film was grown, to form a doubly oxide coated packaging sheet.

18. A process according to claim 17 wherein said oxide coated packaging sheet is attached to said additional bilayer film such that the bilayer film of the oxide coated packaging sheet and the additional bilayer film are adjacent in the doubly oxide coated packaging sheet.

19. A process according to claim 1 wherein said process is repeated to form first and second oxide coated packaging sheets and wherein said first and second oxide coated packaging sheets are adhered together.

20. A process according to claim 19 wherein said first and second oxide coated packaging sheets are adhered together with the bilayer film of each of said oxide coated sheets positioned adjacent to each other.

21. A process according to claim 19 wherein the bilayer film of said oxide coated packaging sheet is covered by attaching an additional sheet of material to said bilayer film.

22. A process according to claim 21 wherein the material of said oxide coated packaging sheet and the material of said additional packaging sheet are made of the same material.

23. A process according to claim 1 wherein said anodization is carried out in an electrolyte which results in the formation of a non-porous barrier layer of aluminum oxide as one layer of said bilayer oxide film.

24. A packaging film of low oxygen and moisture permeability including a bilayer oxide film comprising a layer of aluminum oxide and a layer of an oxide of a metal selected from the group consisting of Ta, Nb and anodizable alloys thereof, said layers being integral;

said packaging film having been produced by a process which comprises:

providing a substrate comprising a metal, at least at an exposed surface of the substrate, selected from the group consisting of tantalum, niobium and anodizable alloys thereof;

forming a coating on said surface of a material selected from the group consisting of aluminum and anodizable aluminum alloys;

anodizing said coated substrate for a sufficient time and at a sufficient voltage to consume said coating and some of said metal of said substrate to form a bilayer oxide film, said anodization being carried out in the presence of a fluoride as an adhesion-reducing agent capable of reducing the strength of attachment of the bilayer film to the remaining metal;

attaching a flexible packaging sheet to said bilayer film; and detaching said flexible sheet and said bilayer oxide film from said remaining metal.

25. A film according to claim 24 wherein said layer of aluminum oxide is porous whereas said layer of metal oxide is non-porous.

26. A film according to claim 24 wherein said metal oxide is an oxide of tantalum.

27. A film according to claim 24 wherein said aluminum oxide layer is porous and wherein pores in said porous layer contain a material deposited therein.

28. A film according to claim 24 wherein said flexible packaging sheet is a polymer.

29. A film according to claim 24 comprising a further bilayer oxide film adhered to said sheet or to said bilayer film.

30. A film according to claim 24 comprising a further packaging sheet adhered to said bilayer film.

31. A film according to claim 24 wherein said layer of aluminum oxide is a non-porous barrier layer and said layer of valve metal oxide is also non-porous.

* * * * *